US007614495B1

(12) United States Patent
Smithers

(10) Patent No.: US 7,614,495 B1
(45) **Date of Patent: *Nov. 10, 2009**

(54) MODULAR BEVERAGE CAN INTERLOCKING DEVICE

(76) Inventor: Matthew Charles Smithers, 502 Price Dr., Lewisville, TX (US) 75067

( * ) Notice: Subject to any disclaimer, the term of this patent is extended or adjusted under 35 U.S.C. 154(b) by 607 days.

This patent is subject to a terminal disclaimer.

(21) Appl. No.: 11/323,281

(22) Filed: Dec. 30, 2005

Related U.S. Application Data

(63) Continuation-in-part of application No. 10/928,609, filed on Aug. 28, 2004, now Pat. No. 7,404,486.

(60) Provisional application No. 60/532,998, filed on Dec. 29, 2003, provisional application No. 60/554,163, filed on Mar. 18, 2004, provisional application No. 60/724,726, filed on Oct. 8, 2005.

(51) Int. Cl.
*B65D 75/00* (2006.01)

(52) U.S. Cl. ..... 206/150; 206/151; 206/153

(58) Field of Classification Search ..... 206/150, 206/151, 153, 427, 139, 503; 446/77; 403/305; 294/87.2, 87.28
See application file for complete search history.

(56) References Cited

U.S. PATENT DOCUMENTS 3,250,564 A * 5/1966 Stern et al. ..... 294/87.2
3,317,087 A * 5/1967 Landis ..... 222/143
3,640,018 A * 2/1972 Light ..... 446/77
3,885,672 A * 5/1975 Westenrieder ..... 206/503
4,120,396 A * 10/1978 Mascia et al. ..... 206/151
4,308,952 A * 1/1982 Paulucci ..... 206/216
4,582,447 A * 4/1986 Itoh ..... 403/305
4,930,636 A * 6/1990 Meadows ..... 206/503
5,964,343 A * 10/1999 Steiner ..... 206/203
6,021,913 A * 2/2000 McGrath ..... 220/513
7,404,486 B2 * 7/2008 Smithers ..... 206/427

* cited by examiner

*Primary Examiner*—David T Fidei

(57) ABSTRACT

A modular beverage can interlocking device that is adapted for forming a plurality of conventional beverage cans into a building block for use as a toy or in display applications. The device generally comprises a plurality of ring-shaped members, each having an upper orifice which is configured with an upper lip retention portion for releasably retaining the top portion of a conventional beverage can via a snap-fit. Conversely, the lower orifice of each of the ring-shaped members is optimally contoured to hold the lower portion of the conventional beverage can via at a snug friction-fit. The top portion of a plurality of beverage cans may be releasably retained in the upper lip retention portion via insertion through the lower orifice, thereby defining a distribution orientation that is optimally suited for distribution of beverage product in the normal manner. Conversely, the top portion of a plurality of beverage cans may be releasably retained in the retention portion via insertion through the upper orifice, whereby the device and cans define a building block for placement one upon another.

24 Claims, 10 Drawing Sheets

MODULAR BEVERAGE CAN INTERLOCKING DEVICE

CROSS-REFERENCE TO RELATED APPLICATIONS

This application is a continuation-in-part of application Ser. No. 10/928,609 entitled MODULAR BEVERAGE CAN INTERLOCKING DEVICE, filed on Aug. 28, 2004 now U.S. Pat. No. 7,404,486, which claims priority under 35 U.S.C. 119(e) on U.S. Provisional application No. 60/532,998 entitled CAN BUILDER, filed on Dec. 29, 2003, by Matthew Charles Smithers, and U.S. Provisional application No. 60/554,163 entitled CAN BUILDER, filed on Mar. 18, 2004, by Matthew Charles Smithers, and U.S. Provisional application No. 60/724,726 entitled CAN BUILDER, filed on Oct. 8, 2005, by Matthew Charles Smithers. This application relies upon, and incorporates by reference, all of the aforementioned patent applications in their entirety.

FIELD OF THE INVENTION

This invention relates generally to the field of promotional products or toys and more specifically to a system of interconnecting a plurality of beverage cans in a modular fashion. The present invention allows beverage cans to be easily assembled into combined modular units for display thereof or for building various structures such as playhouses, forts, or the like.

BACKGROUND OF THE INVENTION

It has been observed that there exists an overabundance of waste materials produced by our society and that means to re-utilize these materials, has for a large part, been overlooked. In recent years, the concept of recycling has gained momentum wherein basic consumer goods such as paper, plastic, glass, aluminum, or the like may be re-instituted into the consumer product chain, thus alleviating the load on the environment. Moreover, as we have become more of a disposable product based society, it has become more important to re-use all the materials we can and in all possible ways. Adding to this is pressure be more responsible with our common resources, especially materials that particularly lends themselves to recycling such as aluminum, paper, glass, and plastic. It has further been observed that our society produces a rather large amount of beverage cans such as those for the containment of soft drinks, beer, or other consumable juices. Research has shown that as many as 156 billion cans were produced in the year of 2003 yet only 42% of these cans were recycled.

In order to provide a use for empty beverage cans, various designs have been suggested which allows a plurality of beverage cans to be releasably mounted one upon another in a modular fashion. U.S. Pat. No. 3,815,281 to Kander, U.S. Pat. No. 4,170,082 to Freedman, U.S. Pat. No. 4,474,491 to Ferrarelli, and U.S. Pat. No. 4,764,143 to Gat, et al. disclose various beverage can stacking devices having varying types of releasable retention mechanism for releasable attachment of the top and bottom ends of a conventional beverage can. However, all of these devices are capable of interconnecting only one can co-axially to another can; the interconnecting of additional cans which are disposed laterally relative thereto must be accomplished via complicated and cumbersome interconnect mechanisms whose retentive strength would most likely degrade due to extended use. Moreover, the interconnect mechanisms as described in the aforementioned patents do not allow a plurality of cans which are laterally interconnected relative to one another to be optimally "packed" together in order to form a building block with minimal spacing therebetween.

Another drawback is that the aforementioned beverage can stacking devices are not easily adapted for packaging and sale along with the beverage product. Each of the stacking devices must be purchased separately from the canned beverage product, thereby diminishing the likelihood of consumer acceptance.

Yet another drawback of the aforementioned designs is that neither device discloses a top portion can engagement member having an annular depression formed therein for resilient retainment of the upper lip of a top portion of a beverage can therein in conjunction with a bottom portion can engagement member for resilient friction engagement of the bottom portion of a beverage container disposed coaxially thereabove. This aspect of the prior art, by itself, reveals a salient utilitarian ramification. The prior art can stacking devices having annular depressions formed in both of the coaxially disposed can engagement members would optimally retain only the top portion of a conventional can, thus inverting the longitudinal orientation of the proceeding can therebeneath, which in turn would hinder the ability to stack additional cans above or below. Moreover, can stacking devices having hollow, cylindrically shaped members formed in both of the coaxially disposed can engagement members would not employ the enhanced releasable securing feature of an annular depression for optimal retainment of the lip portion of a conventional can therein.

SUMMARY OF THE INVENTION AND OBJECTIVES

In accordance with the present invention, there is disclosed a modular beverage can interlocking device comprising a plurality of ring-shaped members, wherein each ring-shaped member has an upper orifice and a lower orifice which provides reliable retention for the bottom end and top end of a conventional beverage can respectively in a substantially co-axial orientation. A plurality of fillets interconnect said plurality of ring-shaped members in a generally co-planar orientation thereby allowing a plurality of said beverage cans to be interconnected side-by-side with respect to each other, such that when the lower orifices of each of said plurality of ring-shaped member are populated with said plurality of beverage cans, a modular style building block is formed which is adapted for stacking, one upon another.

Preferably, the ring-shaped members are disposed in at least one column of multiple evenly spaced linear rows whereby the interlocking device having the lower orifices of the ring-shaped members thereof populated with cans forms a generally rectangular shaped block which is easily interconnected with other populated interlocking devices. Additionally, means are described to allow the usage of varying styles or sizes of beverage cans via multiple inwardly facing annular slots of differing diameter, which are adapted to engage the lip of said can therein.

One aspect of the present invention is a beverage can stacking device that is easily adapted for packaging and sale along with conventional beverage product. The present invention's novel design provides for the selective retention of a plurality of beverage cans, which is optimally suited for dense packaging of the beverage product, as well as having minimal cost, thereby enhancing the likelihood of distribution by beverage producers. The beverage can stacking device allows for selective retention of a plurality of beverage cans in any one of a plurality of configurations such as the so-called six-pack, which can be easily stored or transported. Following removal of the beverage product, the device may then be used for modular stacking of empty beverage cans.

Thus a primary object of the present invention is to provide a means of promoting cans to be recycled into productive useful items.

Another object of the present invention is to provide a beverage can interlocking device which is adapted for packaging and sale of beverage cans having product stored therein.

Another object of the present invention is to provide a means of connecting cans into a repeatable functional unit of building.

Another object of the present invention is to provide a creative promotional item for shipping and selling of liquids in cans.

A further object of the present invention is to provide a means of displaying can collections in a organized manner.

Another object of the present invention is to provide a modular style beverage can interlocking device which obviates the disadvantages of the prior art while providing a device which is inexpensive to manufacture, and thus inexpensive to the end user.

Other objects and advantages of the present invention will become apparent from the following descriptions, taken in connection with the accompanying drawings, wherein by way of illustration and example, preferred embodiments of the present invention are disclosed.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
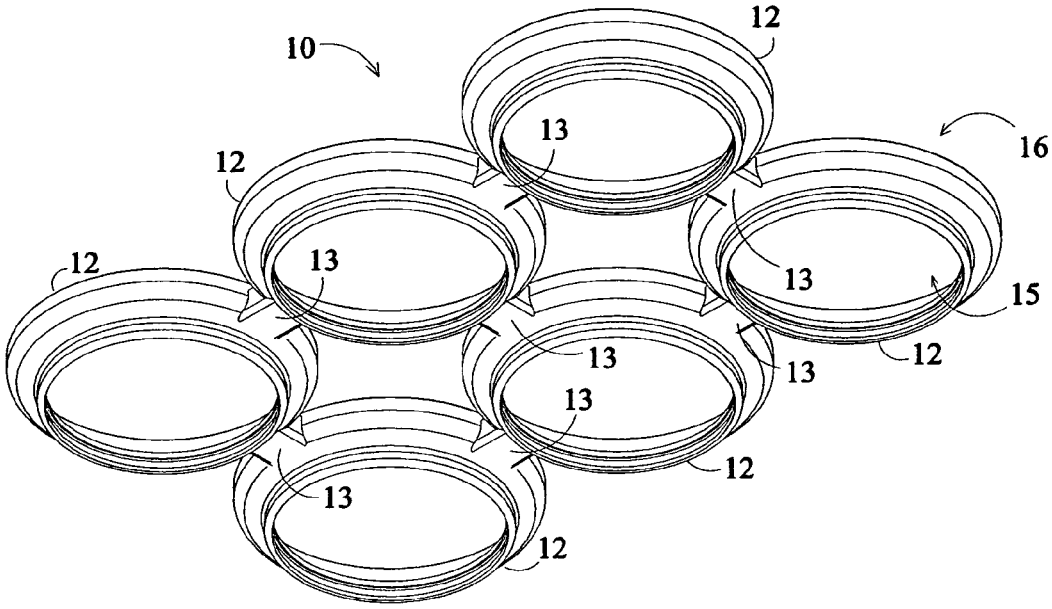
FIG. 1 is a perspective view of a preferred embodiment according to the present invention.
Figure 2:
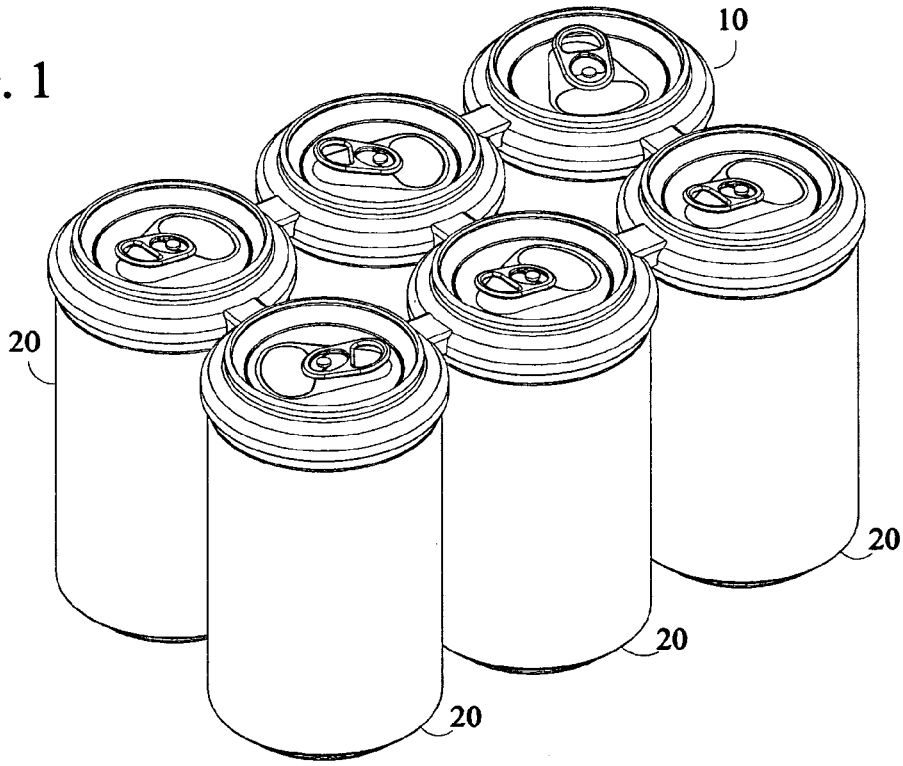
FIG. 2 is a perspective view of the embodiment of FIG. 1, shown with six conventional beverage cans releasably retained within the upper lip retention portion in the distribution orientation.
Figure 3:
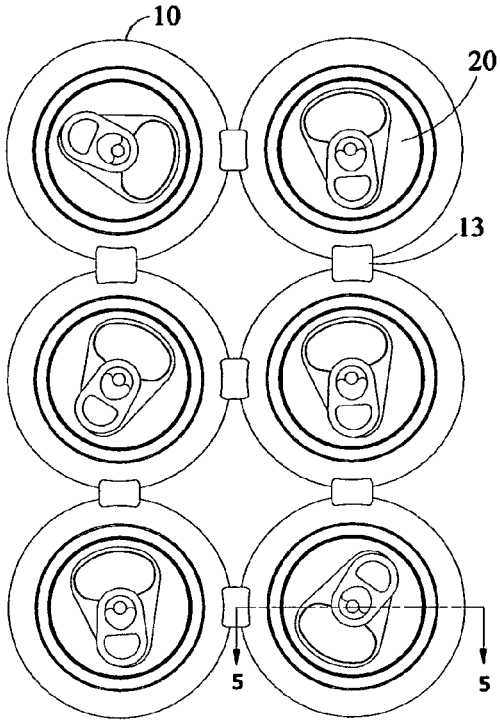
FIG. 3 is a top plan view of the embodiment of FIG. 2.
Figure 4:
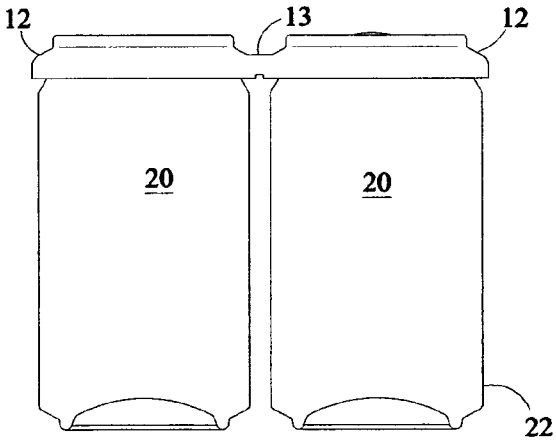
FIG. 4 is a side elevational view of the embodiment of FIG. 2.
Figure 5:
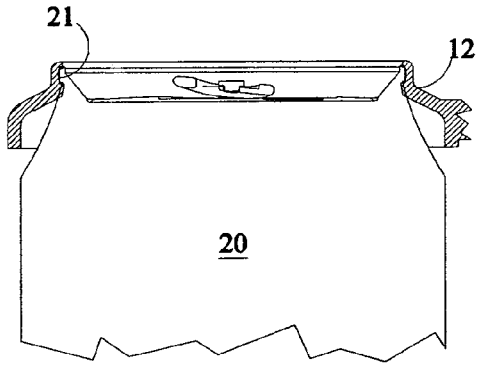
FIG. 5 is a cross-sectional view, taken along the line 5-5 of the embodiment of FIG. 3.
Figure 6:
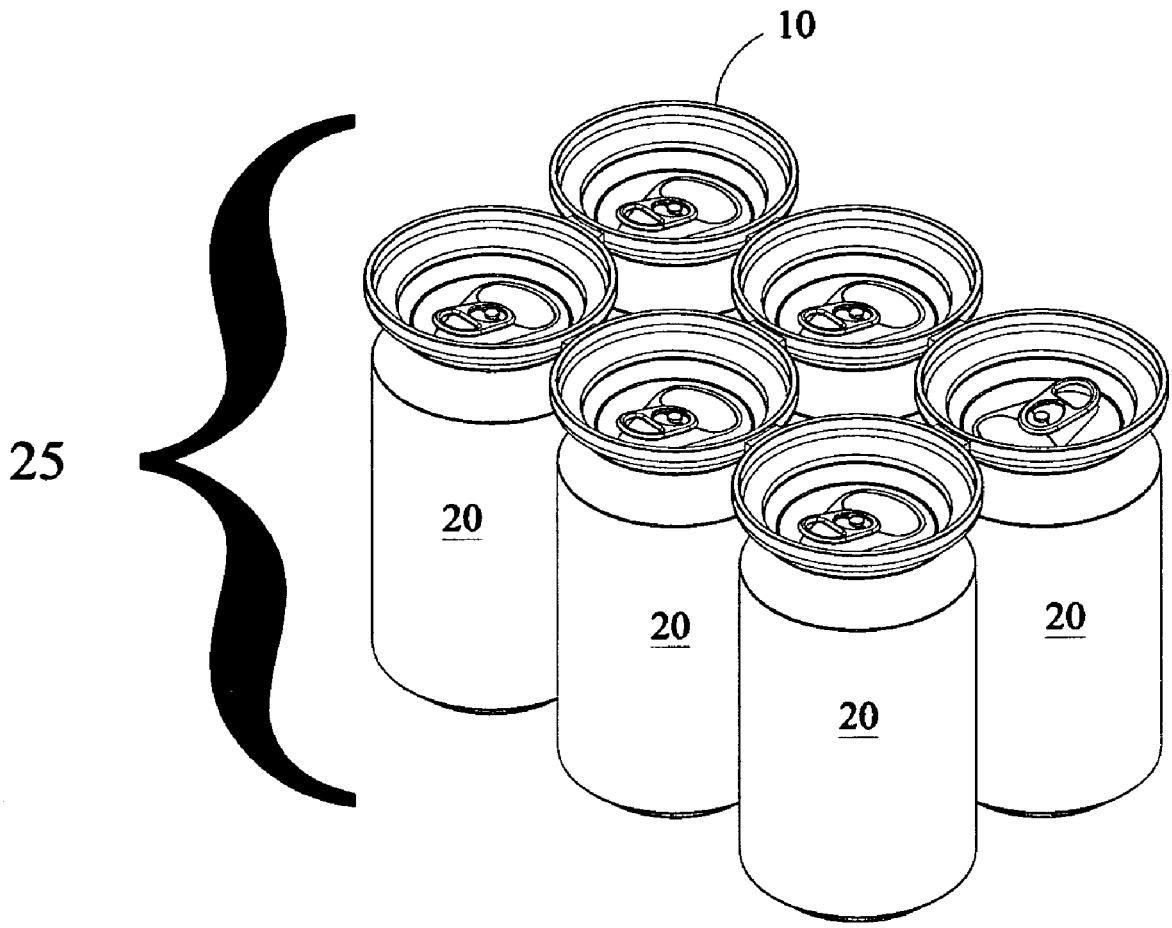
FIG. 6 is a perspective view of the embodiment of FIG. 1, shown with six conventional beverage cans releasably retained within the upper lip retention portion in the building block orientation, thereby forming a building block.
Figure 7:
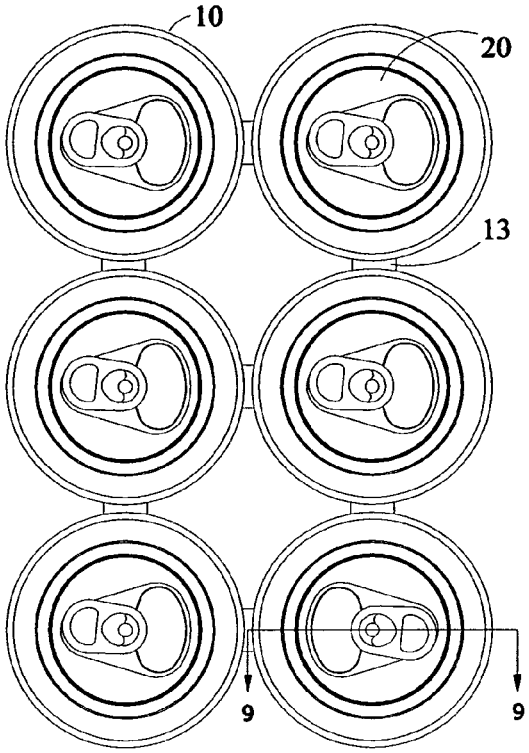
FIG. 7 is a top plan view of the building block of FIG. 2.
Figure 8:
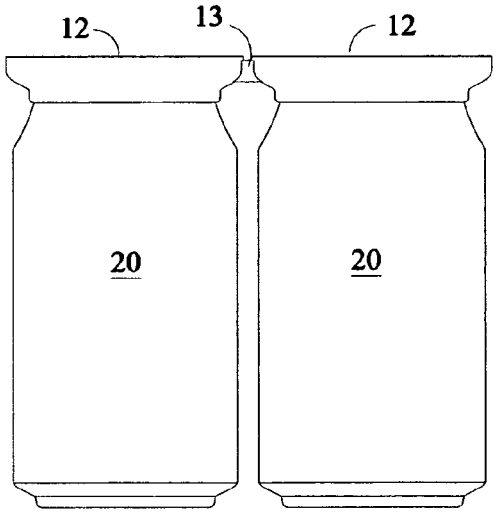
FIG. 8 is a side elevational view of the building block of FIG. 2.

Referring now to the drawings, a modular beverage can interlocking device embodying one preferred embodiment of a device according to the instant invention is designated generally by the reference numeral 10. The beverage can interlocking device 10 is generally shown in FIG. 1 having a plurality of ring-shaped or generally cylindrically-shaped members 12 interconnected via integrally formed inner fillets 13. All members 12 are substantially co-planar in orientation having a lower orifice 15 and an upper orifice 16. The upper orifice 16 has an upper lip retention portion which provides for releasably secure placement of the upper lip 21 of a conventional beverage can 20 thereinto. The lower orifice 15 on the other hand, is adapted for releasably secure placement of the bottom portion 22 of a another can thereinto via a snug friction fit. The lower orifice 15 is also adapted to provide sufficient spacial clearance to allow placement of the upper lip 21 into the upper lip retention portion when inserted through the lower orifice 15 as best shown in FIGS. 4 and 5.

The orientation of the device 10 relative to the releasably secured beverage cans 20 as shown in FIGS. 2 through 5, is defined as a distribution orientation due the ability of packaging a plurality of beverage cans together in a manner that is optimally suited for distribution or sale thereof. Wherein today's beverage product packaging schemes usually entails a package offering to consumers, such as the typical six-pack, the device 10 allows multiple beverage cans to be packaged together in an easily stackable manner. The ability of the device to allow packaging of beverage product provides an enhanced, distinct utility by providing incentive for the purchase of the beverage product, as well as to increase availability of the modular beverage can interlocking device per se to consumers.

Following removal of the beverage cans from the device 10 for consumption of its contents, the empty can may be releasably secured to the device in a building block orientation as best shown in FIGS. 6 through 9. That is, the cans 20 may be releasably secured to the device via insertion thereof through the upper orifice. Thus, the device 10, which has cans that are releasably secured thereto through the lower orifice is defined as the distribution orientation, and the device, which has cans that are releasably secured thereto through the upper orifice is defined as the building block orientation. When the device 10 is populated with cans in the building block orientation, a building block 25 is formed that may be interconnected with other building blocks that are adapted to be stacked upon each other in order to create visual displays of the beverage cans or as a toy to challenge the creative ability of young children.

The modular beverage can interlocking device of the present embodiment is shown having a total of six ring-shaped members 12 which are integrally formed from one piece into two columns of equally spaced linear rows having three members 12 thus forming a two-by-three type configuration; however, other types of integrally formed configurations are possible including a one-by-two configuration, a one-by-three configuration, a one-by-four configuration, or the like. Nevertheless, it is to be appreciated that virtually any type of configuration could be realized including two-by-five, three-by-six, and the like using the concepts and teachings of the present invention. Additionally, it is contemplated that that other geometric configurations such as three ring-shaped members 12 disposed equilaterally apart and maintained in a generally co-planar relation to each other by fillets thereby forming a triangular shape would also be a valid alternative. A further novel concept of the present invention is the ability of the fillets 13 to be selectively cut by a user using a saw or knife in order to split the interlocking device 10 into a plurality of smaller interlocking devices. For example, an interlocking device 10 having a two-by-three configuration may be split by a user into two devices, each having a one-by-three configuration.

Figure 10:
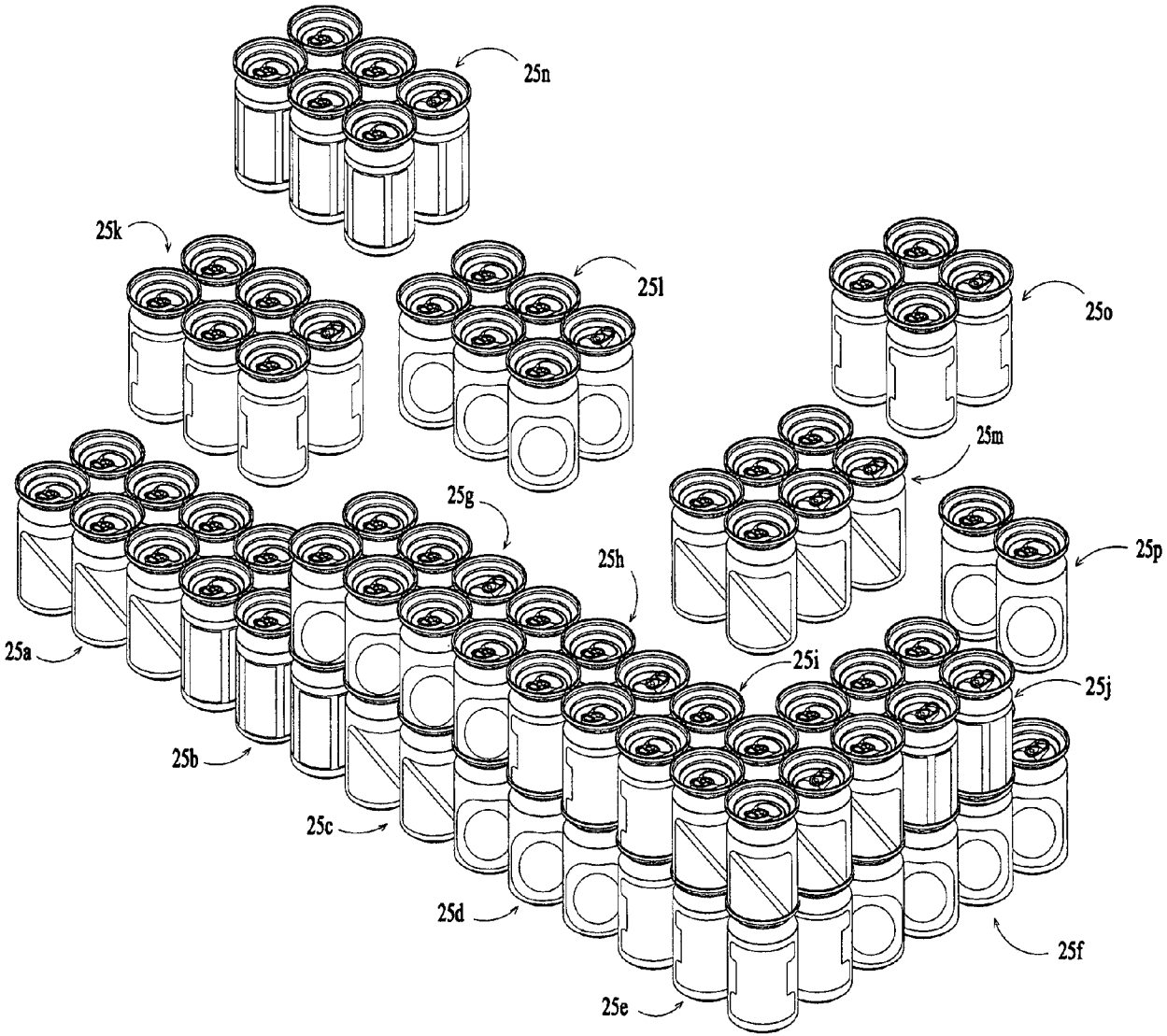
FIG. 10 is a perspective view of a plurality of building blocks, wherein several of the building blocks are stacked upon another, while several others are in proper position for stacking thereupon.
Figure 11:
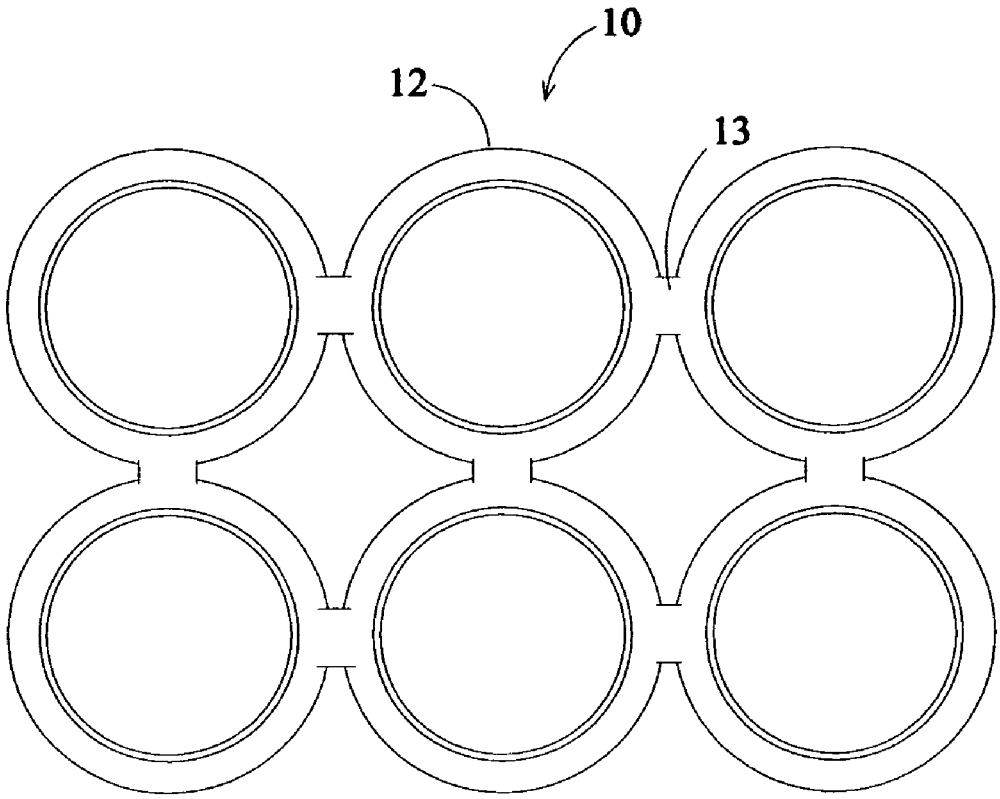
FIG. 11 a bottom plan view of the embodiment of FIG. 1.

FIG. 10 depicts how building blocks of various configurations may be intermingled in order to form a structure, wherein the type of structure formed therewith is limited only by the user's creative ability. As shown, the plurality of building blocks exist as differing types of configurations, and each is populated with beverage cans having indicia or labeling printed thereon, which differs from an adjacently disposed building block in order to uniquely delineate one building block from another. Thus, building blocks 25*a*, 25*b*, 25*d*, 25*e*, 25*e*, 25*h*, 25*i*, 25*j*, 25*k*, 25*l*, 25*m* and 25*n* exist as a two-by-three configuration, blocks 25*f*, and 25*g* exist as a two-by-four configuration, blocks 25*c*, and 25*o* exist as a two-by-two configuration, and block 25*p* exists as a one-by-two configuration. As shown, building blocks 25*a*, 25*b*, 25*c*, 25*d*, 25*e*, and 25*f* form a base for the subsequent placement of other building blocks thereupon. Block 25*g* is placed on top of block 25*b*, 25*c*, and 25*d* in a "straddling" fashion such that the overall structural integrity of the overall structure is enhanced, wherein blocks 25*h*, 25*i*, and 25*j* are placed on top of blocks 25*d*, 25*e*, and 25*f* in a similar manner. Additionally, other blocks (25*k*, 25*l*, 25*m*, 25*n*, 25*o*, and 25*q*) are positioned over the structure and are ready for placement thereon. Blocks 25*o*, and 25*p* show a two-by-two, and one-by-two configuration respectively that may be created by severing predetermined fillets of a device which was originally of a two-by-three configuration.

Figure 9:
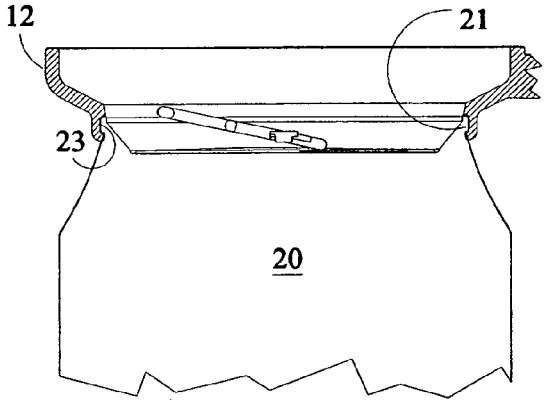
FIG. 9 is a cross-sectional view, taken along the line 9-9 of the building block of FIG. 7.

The upper lip retention portion, which exists within each ring-shaped member 12 will now be described. FIGS. 5, and 9 depict cross-sectional views in which each ring-shaped member 12 is populated with cans in a distribution and building block orientation respectively. As shown, the upper lip retention portion, preferably has an annular slot 23 formed within the inner wall of member 12, which is dimensioned to accept the upper lip 21 of a conventional can therein with a snug, snap-fit. Although the upper lip retention portion provides releasable securement means for a beverage can via a annular slot 23, it will be appreciated by those skilled in the art that other structures such as protruding embossments or snap tabs may be utilized which effectively form a detent mechanism for providing a snap-fit of the upper lip 21 of the can to member 23. Additionally, it may be seen that the upper lip retention portion releasably secures the upper lip to member 23 whether inserted from the lower orifice or upper orifice.

To provide for a snap type fit of the upper lip 21 to portion 23, the device 10 is formed from a resilient thermoplastic exhibiting sufficient resiliency to allow for slight deformation thereof during insertion of the beverage can. The device 19 may be formed of any known thermoplastic material having sufficient resiliency to allow for slight deformation thereof during insertion of the beverage can thereinto. One preferred material used for forming the present embodiment was polyurethane, having a hardness from 95 shore A as measured by ASTM (American Society for Testing and Materials); however, it is to be understood by those skilled in the art that there are numerous types of thermoplastic formulations having varying hardnesses which would be suitable for this purpose.

Figure 12:
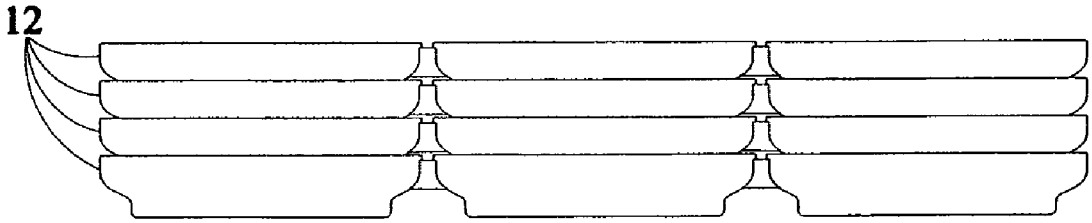
FIG. 12 is a front elevational view of a plurality of interlocking devices according to the present invention, which have been stacked, one upon another.

An additional feature provided by the generally frusto-conical shape of the ring shaped members 12 is the ability to stack multiple devices 10 one upon another in a relatively dense manner. Thus, the upper orifice 16, which is generally smaller in diameter then the lower orifice, may be easily placed thereinto, wherein FIG. 12 shows four devices which are stacked one upon another.

Figure 13:
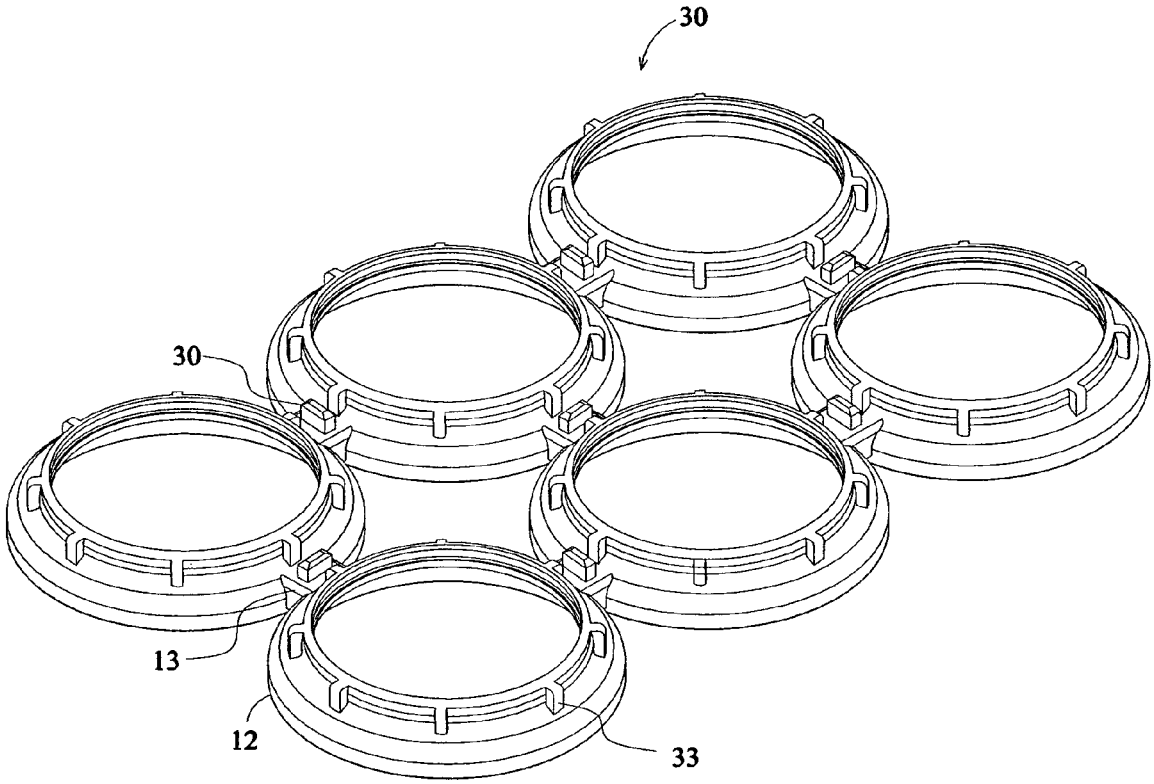
FIG. 13 is a perspective view of an alternative embodiment of the present invention having a stacking retention mechanism configured thereon which allows multiple devices to be selectively secured together while stacked one upon another.
Figure 14:
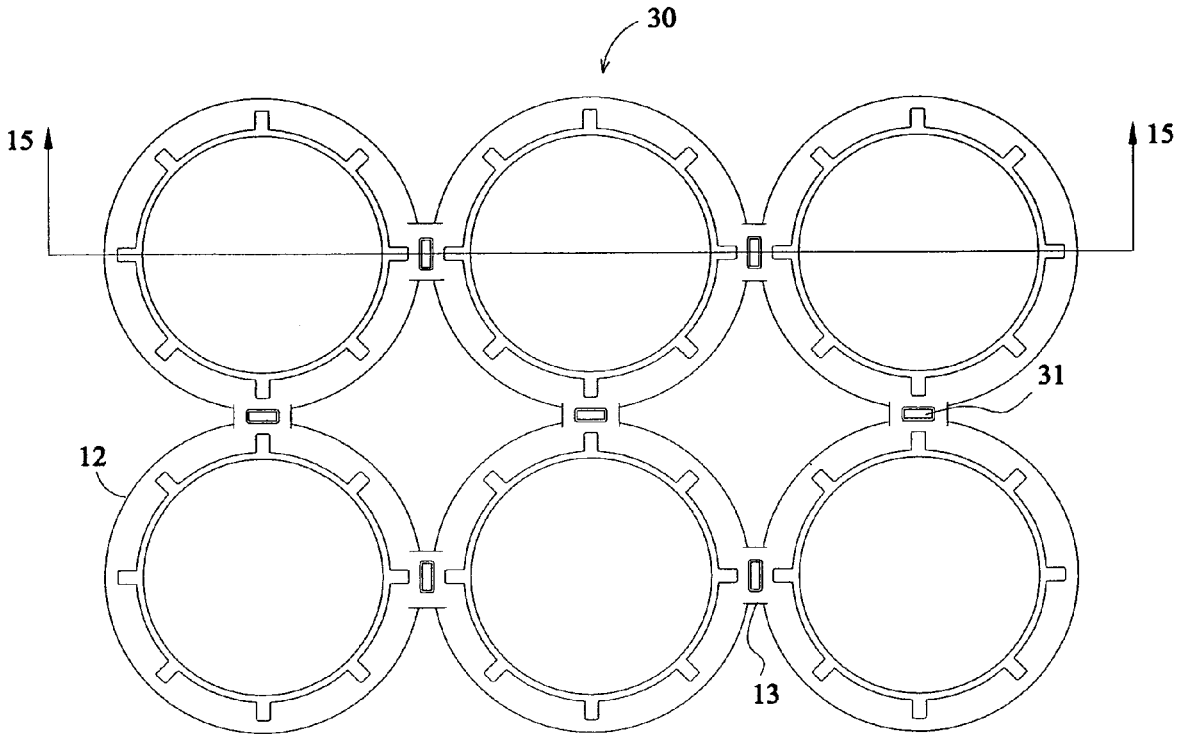
FIG. 14 is a bottom plan view of the embodiment of FIG. 13.
Figure 15:
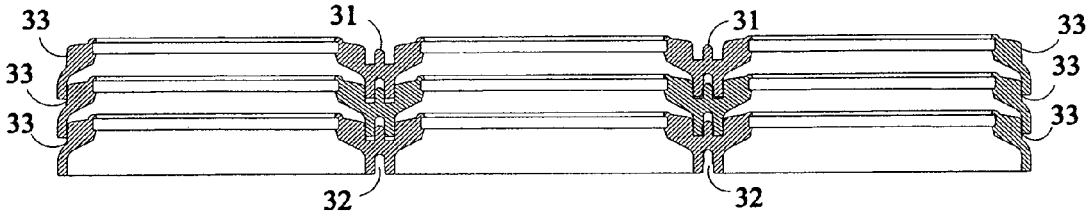
FIG. 15 is a cross-sectional view of a plurality of the embodiments of FIG. 13, which are taken along the lines 15-15 thereof.
Figure 16:
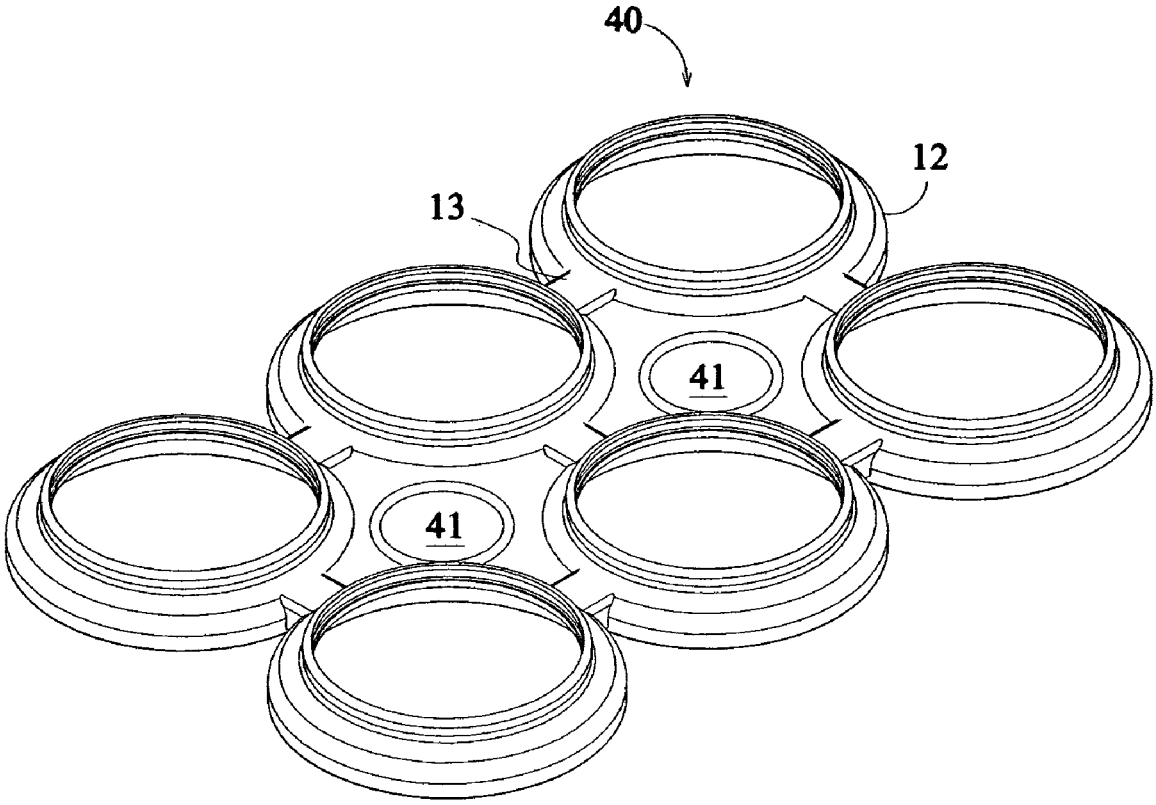
FIG. 16 is another alternative embodiment according the present invention having a handle mechanism incorporated thereon.
Figure 17:
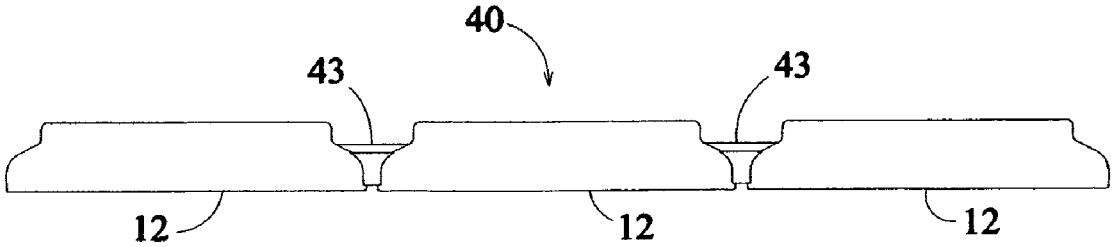
FIG. 17 is a side elevational view of the embodiment of FIG. 16.
Figure 18:
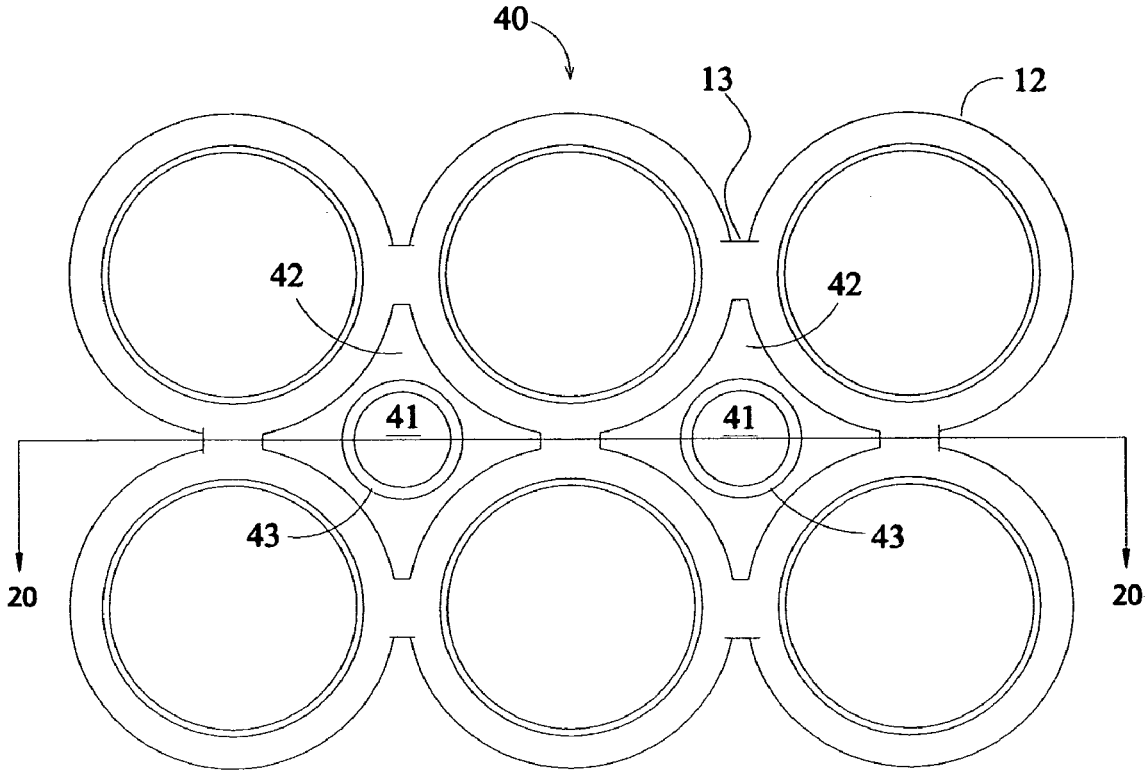
FIG. 18 is a bottom plan view of the embodiment of FIG. 16.
Figure 19:
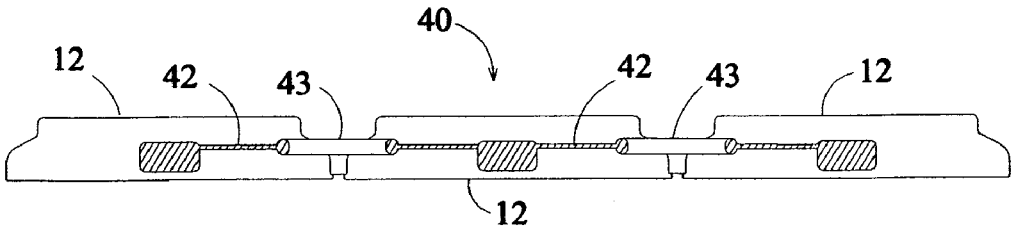
FIG. 19 is cross-sectional view taken along the lines 19-19, of the embodiment of FIG. 18.

Another embodiment 30 of the present invention is shown in FIGS. 13 through 15, which includes an optional stacking retention mechanism which allows multiple devices to be selectively secured together while stacked one upon another. The optional stacking retention mechanism provides utility by enhancing the structural integrity of a plurality of devices that are arranged in a stack such as is shown in FIG. 15. For example, usage of the optional stacking retention mechanism provides for multiple interlocking devices to be easily handled or processed within a manufacturing line for canned beverage products. The ring-shaped members 12, and fillets 13 are functionally similar to the device 10 of FIGS. 1 through 12. The embodiment of FIGS. 13 through 15 differs however in that an optional ring stacking mechanism, and stacking force distribution ledges for enabling the stacking of a plurality of devices 30 one upon another. Thus, consumers or users of the device may be able to store multiple devices in a reasonably stable manner. The optional stacking retention mechanism preferably has a plurality of distally spaced, upwardly extending projections 31, which are preferably integrally formed on each of the fillets 13, are adapted for releasably secure placement into a corresponding plurality of depressions 32 via a snug, friction fit. As best shown in the cross-sectional view of FIG. 15, the depressions 32 extend upwardly into the fillets 13, and have a cross-sectional size that is essentially similar to the cross-sectional size of the projections 31. Although the projections 31, and depressions 32 are adapted to provide a friction type fit, it will be understood by those skilled in the art that the relative shape and size thereof may be easily altered in order to provide a snap-fit or other similar type releasable retention means. As shown, a cross-sectional view of three interlocking devices which are stacked, one upon another such that the projections 31 of one device 30 are each impaled into a corresponding depression 32 of another device 30 disposed thereabove.

Additionally, the device 30 may optionally include a plurality of stacking force distribution ledges for evenly distributing the downward forces placed upon the interlocking device 30, from a another device 30 resting thereupon. The stacking force distribution ledges provide a means to provide even support for the entire periphery of all the ring-shaped members 12 of another device 30 that is stacked thereabove. The stacking force distribution ledges preferably comprises a plurality of upwardly extending tabs 33, which are radially spaced around the periphery of each ring-shaped member 12. As best shown in FIG. 15 the tabs 33 provide even support for another device which is disposed above the device 30 from which the tab 33 is interconnected to.

Another alternative embodiment 40 of the present invention contemplates a handle mechanism which provides for easy manipulation by the hand of a user as shown in FIGS. 16 through 19. The ring-shaped members 12, and fillets 13 are functionally similar to the embodiment of FIGS. 1 through 12, however the embodiment of FIGS. 16 through 19 differs in that a handle mechanism is included, which incorporates finger holes 41 for manipulation by the hand of the user. Each of the finger holes 41 generally comprise a through hole, which is formed in a web-like, membrane 42, which extends between, and is bounded by the outer periphery of adjacent ring-shaped members 12, and their associated fillets 13. Each of the holes 41 are sufficiently large to allow placement of a finger or thumb of the user thereinto, and preferably incorporates an integrally formed annular ring 43 for relieving the stress placed upon the finger of a user, during the lifting operation. Each of the web-like membranes 42, and their associated annular rings 43 are preferably integrally formed with the ring-shaped members 12 and associated fillets 13 during manufacture. In use, a device 40, which is typically populated with canned beverages may be easily lifted and transported in the normal manner by inserting a finger into each of the holes 41. Following transport of the populated device to its desired destination, the beverages may be consumed and the device 40 re-populated with empty cans in order to form a building block as previously described.

The present invention may be embodied in other specific forms without departing from the spirit or scope of the invention. Therefore, the described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

What is claimed is:

1. A modular beverage can interlocking device for releasable retention of a plurality of beverage cans, wherein each of said beverage cans has a top end and a bottom end, said device comprising:

a plurality of ring-shaped members having an upper orifice and a lower orifice, said upper orifice generally conforming to the shape of the top end of said can for releasable retention therein, and said lower orifice having a relatively greater inside radius than the inside radius of the upper orifice and transitioned from the upper orifice by a section of the member having the inner shape of a frustum, with the lower orifice generally conforming to the bottom end of said can for releasable retention therein; and, a plurality of fillets which are integrally formed with said plurality of ring-shaped members, said plurality of fillets interconnecting said plurality of ring-shaped members in such a manner to maintain said ring-shaped members in a generally co-planar relationship to each other;

whereby inserting the top end of each of said beverage cans through said lower orifice defines a distribution orientation, and alternatively inserting the top end of each of said beverage cans through said upper orifice defines a building block orientation.

2. The modular beverage can interlocking device of claim 1, further comprising an upper lip retention portion which is adapted to releasably retain the top end of said can via a snap fit.

3. The modular beverage can interlocking device of claim 2, wherein said upper lip retention portion is an inwardly facing annular slot which extends around said upper orifice.

4. The modular beverage can interlocking device of claim 1, wherein said lower orifice is adapted to releasably retain the bottom end of said beverage can via a friction fit.

5. The modular beverage can interlocking device of claim 1, further comprising a stacking retention mechanism which allows a plurality of said devices to be selectively secured together while stacked one upon another, said stacking retention mechanism including a plurality of projections which is adapted for releasable securement to a corresponding plurality of depressions when said devices are stacked one upon another.

6. A modular beverage can interlocking device for releasable retention of a plurality of beverage cans, wherein each of said beverage cans having a top end and a bottom end, said device comprising:

a plurality of ring-shaped members having an upper orifice and a lower orifice, said upper orifice having an upper lip retention portion for releasable retention of the top end of said beverage can, and said lower orifice having a relatively greater inside radius than the inside radius of the upper orifice and transitioned from the upper orifice by a section of the member having the inner shape of a frustum, with the lower orifice generally conforming to the bottom end of said can for releasable retention therein; and, a plurality of fillets which are integrally formed with said plurality of ring-shaped members, said plurality of fillets interconnecting said plurality of ring-shaped members in such a manner to maintain said ring-shaped members in a generally co-planar relationship to each other;

whereby inserting the top end of each of said beverage cans through said lower orifice such that said top end is releasably secured in said upper lip retention portion defines a distribution orientation, and alternatively inserting the top end of each of said beverage cans through said upper orifice such that said top end is releasably secured in said upper lip retention portion defines a building block orientation, wherein said device and said beverage cans defining a building block for stacking one upon another.

7. The modular beverage can interlocking device of claim 6, wherein said upper lip retention portion is an inwardly facing annular slot which extends around said upper orifice.

8. The modular beverage can interlocking device of claim 6, wherein said lower orifice is adapted to releasably retain the bottom end of said beverage can via a friction fit.

9. The modular beverage can interlocking device of claim 6, further comprising a stacking force distribution ledge for evenly distributing the downward forces placed upon said device while in said distribution orientation, said distribution ledge being integrally attached to the outer periphery of each of said ring-shaped members proximate the upper orifice thereof.

10. The modular beverage can interlocking device of claim 6, wherein the plurality of said ring-shaped members are disposed in at least one column of equally spaced linear rows, wherein said rows comprise at least two said ring-shaped members.

11. The modular beverage can interlocking device of claim 6, wherein said fillets are cutable by a user in order to form two smaller beverage can interlocking devices.

12. The modular beverage can interlocking device of claim 6, wherein said plurality of ring-shaped members and plurality of fillets are integrally formed from one piece of thermoplastic material.

13. The modular beverage can interlocking device of claim 6, further comprising a handle mechanism, said handle mechanism having a plurality of finger holes which is adapted for placement of the fingers of said user therethrough, said finger holes being formed in a web-like membrane which extends in between adjacent said ring-shaped members and said fillets.

14. A modular beverage can interlocking device for releasable retention of a plurality of beverage cans, each of said beverage cans having a top end and a bottom end, said device comprising:

a plurality of ring-shaped members having an upper orifice and a lower orifice, said upper orifice having an upper lip retention portion for releasable retention of the top end of said beverage can, and said lower orifice having a relatively greater inside radius than the inside radius of the upper orifice and transitioned from the upper orifice by a section of the member having the inner shape of a frustum, with the lower orifice generally conforming to the bottom end of said can for releasable retention therein; and, a plurality of fillets which are integrally formed with said plurality of ring-shaped members, said plurality of fillets interconnecting said plurality of ring-shaped members in such a manner to maintain said ring-shaped members in a generally co-planar relationship to each other;

whereby each of said beverage cans may be inserted into a corresponding each of said ring-shaped members through either the upper or lower orifices thereof such that said top end is releasably secured within said upper lip retention portion, wherein said insertion of said top end through said lower orifice defines a distribution orientation, and said insertion of said top end through said upper orifice defines a building block orientation.

15. The modular beverage can interlocking device of claim 14, wherein said upper lip retention portion is an inwardly facing annular slot which extends around said upper orifice.

16. The modular beverage can interlocking device of claim 14, wherein said lower orifice is adapted to releasably retain the bottom end of said beverage can via a friction fit.

17. The modular beverage can interlocking device of claim 14, wherein the plurality of said ring-shaped members are disposed in two columns of equally spaced linear rows, wherein said rows comprise three of said ring-shaped members.

18. The modular beverage can interlocking device of claim 14, further comprising a stacking retention mechanism which allows a plurality of said devices to be selectively secured together while stacked one upon another, said stacking retention mechanism including a plurality of projections which is adapted for releasable securement to a corresponding plurality of depressions when said devices are stacked one upon another.

19. A modular device comprising:

(1) plural can holders, each can holder comprising:

(a) a first section having the shape of a hoop with a first radius, the first section being relatively thin in the direction of its radius; the first section having an annular recess in its interior elongated side; and, (b) a second section, the second section being relatively elongated in the direction of its axis and relatively thin in the radial direction, the second section having a first axial end having a radius equal to the radius of the first section and a second axial end opposite the first axial end, the second axial end having a radius larger than the first radius; and, (c) a third section having the shape of a hoop with a radius equal to the radius of the second axial end of the second section, the third section being relatively elongated in the direction of its axis and being relatively thin in the direction of its radius; and, (d) the first, second, and third sections arranged along a common axis with the second section interposed between the first and third sections; and, (e) one axial end of the first section integrally joined to the first axial end of the second section, and one axial end of the third section integrally joined to the second axial end of the second section; and, (2) means for holding the plural can holders together in a generally co-planar relationship to each other so that the axes of the individual can holders are generally parallel.

20. The modular device of claim 19 wherein the second section has the shape of a frustum.

21. The modular device of claim 19 wherein the plural can holders are integrally formed of thermoplastic material.

22. The modular device of claim 19 wherein the plural can holders and the means for holding the plural can holders together are all integrally formed from a thermoplastic material.

23. The modular device according to claim 19 in which inserting a top end of a beverage can through the third section defines a distribution orientation, and alternately inserting the top end of the beverage can into the first section defines a building orientation.

24. The modular device according to claim 19 in which the first section generally conforms to a top end of the beverage can and said second and third sections together generally conform to a bottom end of the beverage can and is releasably held therein by friction fit.

* * * * *